United States Patent [19]

Nopper

[11] Patent Number: 5,023,027

[45] Date of Patent: Jun. 11, 1991

[54] PROCESS FOR PRODUCING FIBROUS MATS AS A STARTING MATERIAL FOR COMPRESSION MOULDED ARTICLES

[75] Inventor: Herbert Nopper, Kuppenheim, Fed. Rep. of Germany

[73] Assignee: Casimir Kast GmbH & Co., KG, Gernsbach, Fed. Rep. of Germany

[21] Appl. No.: 697,452

[22] Filed: Feb. 1, 1985

[30] Foreign Application Priority Data

Feb. 3, 1984 [DE] Fed. Rep. of Germany ..... 3403670

[51] Int. Cl.[5] ..... D04H 1/58; B27N 3/12

[52] U.S. Cl. ..... 264/37; 264/510; 264/518; 264/113; 264/118; 264/119

[58] Field of Search ..... 264/518, 112, 113, 109, 264/510, 118, 119, 37

[56] References Cited

U.S. PATENT DOCUMENTS

| | | | |
|---|---|---|---|
| 2,543,101 | 2/1951 | Francis | 264/112 |
| 2,993,239 | 7/1961 | Heritage | 264/518 |
| 3,632,371 | 1/1972 | Mikulka | 264/113 |
| 3,880,975 | 4/1975 | Lundmark | 264/119 |
| 3,905,864 | 9/1975 | Curry et al. | 264/518 |
| 3,975,483 | 8/1976 | Rudloff | 264/112 |
| 4,028,288 | 6/1977 | Turner | 264/109 |
| 4,141,772 | 2/1979 | Buell | 264/113 |

FOREIGN PATENT DOCUMENTS

| | | | |
|---|---|---|---|
| 1592545 | 6/1970 | France | 264/518 |

*Primary Examiner*—Mary Lynn Theisen

*Attorney, Agent, or Firm*—Antonelli, Terry, Stout & Kraus

[57] ABSTRACT

In a process for producing fibrous mats as a starting material for compression moulded articles, fiberized waste materials are mixed with thermoplastic and/or thermoset or thermosetting binders, the mixture is spread onto an air-permeable conveyor belt to give a first fleece layer, on said fleece layer is loosely placed a polyester fabric or lattice with at least partly multifilament threads, a mesh size between 4 and 7 mm and a thermoset or thermosetting finish, then a second fleece layer is spread onto the fabric or lattice and then the layers are compressed at elevated temperature and under pressure to give a transportable mat, from which individual moulded articles are produced by compression moulding at temperatures between 180° and 220° C., the polyester fabric undergoing thermal conditioning prior to its use at temperatures roughly corresponding to the mould temperature. In this way, during the forming of the mat to give a compression moulded article, there is no need for stabilizing layers above and below the mat and the moulded articles can be produced in a single-stage moulding process.

6 Claims, 4 Drawing Sheets

PROCESS FOR PRODUCING FIBROUS MATS AS A STARTING MATERIAL FOR COMPRESSION MOULDED ARTICLES

BACKGROUND OF THE INVENTION

The present invention relates to a process for producing fibrous mats as the starting material for compression moulded articles, in that fiberized waste materials are mixed with thermoplastic and/or thermoset or thermosetting binders, the mixture is spread onto an air-permeable conveyor belt to form a fleece and the fleece is compressed at elevated temperature and under pressure to give a transportable mat, from which individual moulded articles are produced by compression moulding at temperatures between 180° and 220° C.

In German Patent 2,845,112, the continuously produced mat is separated after compression into individual blanks, which are dimensioned in accordance with the compression moulded article to be produced therefrom. Particular difficulty is caused in the processing of these blanks to compression moulded articles when the latter have deep shaped-out areas, because the starting material cannot absorb tensile forces, so that, on compression moulding, the material can be thinned out and consequently tear as a result of the combined tensile and shear forces. This also applies in the case of other known mats, which are produced e.g. from cellulose or lignocellulose fibres, instead of fiberized waste materials.

In order to be able to produce complicated and deeply shaped moulded articles from such mat blanks, further aids must be used during the moulding process, namely, a stabilizing substrate on which the mat is placed during the moulding process and a stabilizing support placed above the mat blank. Essentially, two ways have been adopted for this purpose, namely, either constructing the two stabilizing layers in elastic or rubber like manner (DE-AS 2,701,480 and 2,759,279) or to use a substantially non-expanding material (DE-AS 2,713,527). In both cases, the stabilizing layers have the function of enclosing the mat blank between them and during the moulding process to supply it into the deep contours of the lower mould, i.e. to ensure a completely satisfactory tightening of the material. In the first case of elastic stabilzing layers, during the moulding process they are elastically expanded, leading to the entrainment of at least the directly adjacent layers of the mat blank as a result of frictional forces. Thus, thinning out can still occur and is accompanied by tearing. In the second case of the largely expansion-free stabilizing layers, a type of sandwich pack is deliberately produced from the two layers and the intermediate mat blank, the mat being largely gripped between the stabilizing layers during the moulding process and follows the movement of the latter due to its fabric-like surface structure. In both cases and, particularly in the case of moulding processes with large strokes, it has been proposed to elastically suspend the upper stabilizing layer, in order to be able to at least absorb the idle stroke of the upper mould of the press, without expanding or stretching the stabilizing layer (e.g. German Patent 3,001,750). Generally, moulding must take place in two-stage form, in that in the first stage working with the aforementioned stabilizing layers, a preform is produced, which roughly has the contour and a generally larger wall thickness. In the second stage, the preform is compression moulded to its final shape.

As a result of these measures, which are essential in the case of complicated compression moulded articles, naturally a complicated apparatus construction arises with a preforming press and a final shaping press. In the case of extremely complicated compression moulded articles, at least one of the preforming moulds, generally the upper mould, must be subdivided into a plurality of elements, in order to be able to successively produce different parts of the mat blank and permit a satisfactory, i.e. substantially tension-free tightening of said blank (DE-AS 2,338,650). In addition, over a period of time, the stabilizing layers are subJect to wear, i.e. become permanently deformed, so that at relatively short intervals of one to two weeks they have to be replaced, which leads to corresponding increases in equipment costs.

SUMMARY OF THE INVENTION

The aim underlying the present invention is to propose a process and an apparatus for performing the same, with the aid of which it is possible to produce mats, which can be formed to compression moulded articles with a random shape in a single operating step and without the aid of stabilizing layers.

On the basis of the aforementioned process, this problem is solved in that, accompanied by constant action of vacuum on the bottom of the conveyor belt, a polyester fabric or lattice with at least partly multifilament threads, a mesh size between 4 mm and 7 mm and a thermostat or thermosetting, heat-activatable finish which has an affinity to the binder of the fibres is loosely placed on a first fleece layer on the underside of the conveyor belt, subsequently a second fleece layer is spread onto the fabric or lattice and then the layers are compressed to form a mat and prior to the use of the polyester fabric or lattice at temperatures roughly corresponding to the mould temperature during moulded article production, it undergoes thermal conditioning.

It is admittedly known, in connection with the production of mats and sheets from chip or fibrous material, to provide tension-proof intermediate layers, for which threads, fabrics, foils, etc have been proposed. However, these intermediate layers are exclusively used for improving the strength values of the mat or sheet. It has not proved possible as a result of this measure in connection with the aforementioned starting material to render superfluous the stabilizing layers for the forming process. Thus, to the extent that they are used for producing compression moulded articles, the aforementioned fibrous materials have been exclusively formed with stabilizing layers. This is no longer necessary in the case of the present invention. In the case of the process steps according to the invention, this objective is achieved by the following interactions.

The choice of a polyester fabric is initially based on cost considerations, because other fabrics with a comparable physical and chemical characteristic spectrum are more expensive. Importance is also attached to its high tensile strength and in particular its thermal stability at the presently necessary mould temperatures of between 180° and 220° C. The melting point of polyester fabric is above 220° C. and it has the further positive property that its tensile strength only deteriorates slightly in the higher temperature range. As in virtually all other plastic fabrics, it is a disadvantage of the polyester fabric that it has a considerable thermal expansion, which is however reversible up to high temperatures. However, this would be disadvantageous for the process according to the invention, because the resilience effects would lead to material displacements within the mat during the production of the latter and following its heating and compression, so that the existing sandwich would be loosened. The same effect would occur on forming the mat to the compression moulded article, so that stresses remain within the moulding. In both cases, this easily leads to delamination, so that the mat or moulding would be unusable. This disadvantage is obviated by the further measure according to the invention, in that the polyester fabric undergoes thermal conditioning at temperatures roughly corresponding to the mould temperature and this can take place before or after finishing. As a result, the polyester fabric largely uses its initially present thermal expansion so that, during the heating of the fleece prior to producing the mat and during the production of the compression moulded article, it only expands to a relatively minor degree, so that the mat or compression moulded articles are substantially free from tension and shrinkage.

The polyester fabric finish must be heat-activatable so that, during the heating of the fleece prior to the compression to form the mat, it at least undergoes surface melting and in this way bonds the fibres of the upper and lower fleece layers. However, the finish must be selected in such a way that it is still adequately reactivatable following the production of the mat to ensure that it completely hardens during the moulding process and fulfils its function as a supportive binder. As is known per se, the finish is also used for making the fabric non-slip, so that during all the processing processes, the individual fibres do not move relative to one another and the diagonal stretching of the fabric is minimized.

The further inventive measure, according to which there is at least a percentage of multifilament threads within the polyester fabric acts in the same direction. These threads on the one hand ensure better adhesion of the duroplastic finish and on the other lead to a better bonding with the adJacent fibres of the upper and lower fleece layers. Furthermore, and further reference will be made to this hereinafter, they facilitate the utilization of the waste obtained through trimming operations, which can then be more easily fiberized again and supplied for fleece production.

The mesh size of 4 mm to 7 mm according to the invention ensures that a fibre and binder interchange can take place between the two fleece layers. During the production of the mat, this is also aided by the fact that throughout fleece production a vacuum acts on the underside of the conveyor belt and ensures that the lower fleece layer retains a constant thickness and does not "spring up" or only does this to an insignificant extent after passing through a per se known levelling means. The fabric is subsequently loosely applied, i.e. deposition must take place in a tension-free manner, in order once again to prevent the introduction of forces. The fabric is also sucked onto the lower fleece layer by the vacuum, so that it cannot be deformed or displaced following deposition. The same effect occurs during the spreading on of the second fleece layer. As a result of the vacuum, the fibres of the upper fleece layer are drawn by the relatively wide-mesh lattice structure of the fabric onto the lower fleece layer, so that there is already a loose union between the two layers. During the subsequent heating of the fleece, the binder is activated and there is an at least surface bonding of the fibres. The union is further improved during the subsequent compression to form the mat. Compared with the known processes, this means that the mat can much more easily be transported and handled.

Practical tests have shown that a mat produced in this way or blanks obtained therefrom can be processed to compression moulded articles with random contours without the use of preforming moulds and without separate stabilizing layers. The enormous cost and labor savings are obvious. In addition, the process according to the invention leads to an efficiency increase of up to 30%. Moreover, the final strength of the moulded article is improved and as a result of the thermal stability of the polyester fabric, it is not degraded at even elevated temperatures. Due to the higher strength, it is possible to reduce the material density of the moulded article and consequently its wall thickness. This is particularly important when using such moulded articles for the internal finishing of motor vehicles, because it is then possible to save weight. A mat produced according to the invention can, in the case of simpler moulded articles, be formed or shaped in one stage in a heated press without preheating taking place. However, in the case of more complicated moulded articles, dry preheating is necessary. As has already been stated, the waste obtained by trimming during forming can be directly supplied again for fleece production.

According to an advantageous embodiment, the cross-section of at least part of the threads of the fabric or lattice can have a greater extension parallel to the fleece plane than at right angles thereto. For example, the threads can be constructed in strip-like or cross-sectionally oval manner. If e.g. all the threads in the warp or weft do not have this cross-section, they will at least be provided in the central regions of the mat where generally the greatest deformations occur during moulding. The cross-sectional shape has the advantage that the threads do not cut into the material during forming.

The fabric or lattice finish preferably consists of phenolic, phenol-resorcinol or melamine resins, or alternatively styrene - butadiene latex with reactive carboxyl groups (SBR), which can be modified by the aforementioned resins and other additives. These resins or latexes have the advantage that they are in certain circumstances multiply heat-activatable. They can also be used in the same form as binders or as part of a binder system for fibres of different types. Under heat action, the finish forms a firm bond with the thermoplastic components within the fibrous material or binder, so that the fabric or lattice is firmly bound into the mat. The afore-mentioned choice of materials for the finish is also significant relative to the utilization of the waste obtained during trimming. The fiberized waste, which can be supplied again to the fleece production process, must contain no components which, if appearing on the fleece surface, have an adhesive action relative to the metal surfaces of the compression moulds. This condition is not only fulfilled by the fabric or lattice polyester, but also by the aforementioned materials for the finish.

Advantageously, after compression, the mat is wound into rolls or reels and processed from the latter during the production of the moulded articles in that the conveying forces act directly on the mat or the waste strips obtained after the trimming of each moulded article and connected via the remaining fabric or lattice.

It has already been proposed (DE-AS 2,365,895) to provide a wood fibre mat with a highly elastic carrier layer in its central region and to press into the mat a plurality of regularly distributed areas of reduced cross-section, so that a type of honeycomb or sandwich structure is obtained. The edges of this mat are to be provided with tension strips, so that the mat and the remaining waste strips can be wound onto drums. A highly elastic carrier layer is not in a position to achieve the objective of the invention, because it is not sufficiently thermally stable. In addition, relative movements with respect to the fibrous layers occur during any tensile stressing of the fabric, so that existing bonds between the materials are torn away again, or shearing stresses occur within the moulded article. Moreover, the use of different materials for the carrier layer and the tension strips leads to corresponding expanditure for the storage and incorporation of the materials into the fleece. Finally, the honeycomb structure leads to irregularities in the surface and density of the moulded articles. All these disadvantages do not appear in the case of the process according to the invention, so that for the first time it is possible to work mats of this type from the reel.

As has already been stated, in the case of the process according to the invention, the waste strips obtained both during the production of the individual blanks and during the trimming of the compression moulded articles can be fiberized and the fiberized waste materials can be added again prior to fleece formation.

For performing this process, the invention uses as a basis a known apparatus (German Patent 2,845,112), which has a spreading means which applies the mixture of fiberized waste materials and binders onto an air-permeable conveyor belt, a suction means arranged below the conveyor belt, a following means for levelling the fleece, means for passing hot air through the fleece positioned behind and above the conveyor belt, as well as pressure rollers acting on the fleece.

According to the invention, this plant is modified in that the levelling means is provided behind a supply means for the loose deposition of the polyester fabric or lattice, behind this is provided a second spreading means for applying the second fleece layer and behind this a further levelling means, the one or more suction means extending from the first spreading means to the hot air means.

This plant fulfils the aforementioned requirement of ensuring a mechanical bond between the individual layers through the vacuum acting on the fleece throughout the entire production of the latter. The loose deposition of the fabric or lattice can be achieved by a synchronized control of the conveyor belt and the fabric reel.

If working does not take place with individual blanks, according to a further embodiment, a winding means for winding up the mat can be arranged behind the pressure rollers.

The processing or working of mat from the reel made possible by the invention also offers the possibility of further developing the apparatus for producing the compressed moulded articles, which, in known construction, has a mat supply station, optionally a preheating station, a moulding station and a removal station for the finished moulded article that at the supply station is provided a winch for receiving a mat reel and behind the removal station a winding means for winding up the waste strips obtained during the trimming of the moulded article and for simultaneously conveying the mat through the moulding station.

Compared with the prior art, this moulding apparatus construction makes it possible to achieve a fully mechanized processing of the mat. Thus, it is possible to save the labor force required for depositing the mat blanks and for removing the waste pieces. Thus, it is merely necessary to have one supervisor, possibly for several apparatus systems. There is also a considerable reduction to the prejudicial effects to the work places as a result of the action of heat, vapors, etc.

In this embodiment, the mat reel is preferably mounted in a loosely rotatable manner on the winch and the winding means is driven at the rhythm of the moulding station.

As a result of the loose mounting of the mat reel on the winch, the mat is tightened in an unhindered manner during the removal of the compression moulded article, i.e. the material requirement for tightening is covered by the delivery reel.

BRIEF DESCRIPTION OF THE DRAWINGS

The invention is described in greater detail hereinafter relative to non-limitative embodiments and the attached drawings wherein.

DETAILED DESCRIPTION

Figure 1:
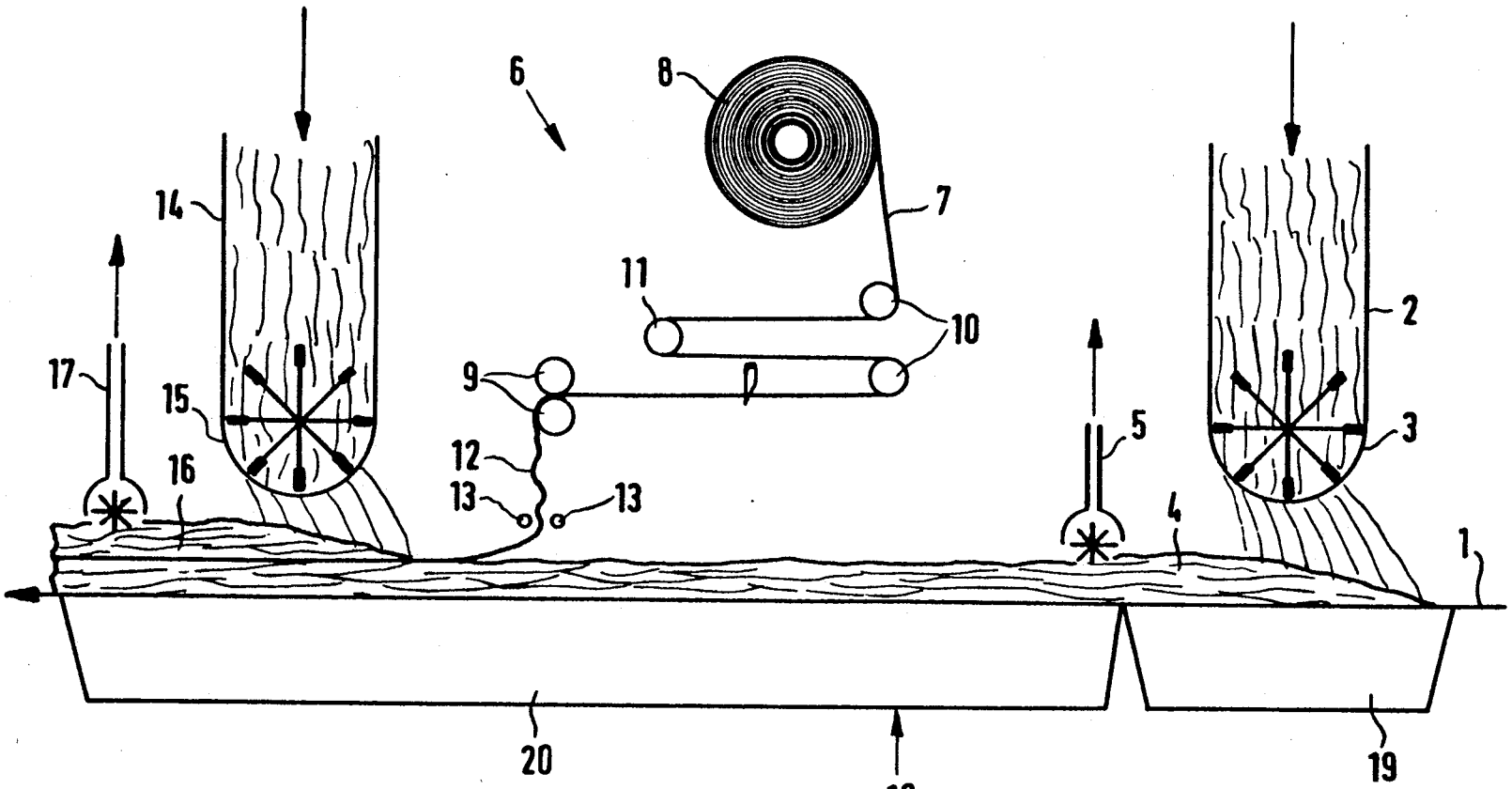
FIGS. 1 and 2 are schematic side views of the mat production apparatus of the present invention.

Referring now to the drawings wherein like reference numerals are used throughout the various views to designate like parts and, more particularly, to FIG. 1, according to this Figure, a mat production apparatus includes an air-permeable conveyor belt 1 made from, for example, a fabric or lattice with a first spreading means 2 being arranged above the entrance of conveyor belt 1 into the plant. The first spreading means 2 receives a fibrous material and supplies it, via a spreading head 3, onto the conveyor belt 1 for forming a first fleece layer 4. Behind or upstream of the spreading means 2, as viewed in the conveying direction, is located a mill-like levelling means 5, which brings the fleece layer 4 to a uniform thickness.

In the conveying direction behind or upstream of the levelling means generally designated by the reference numeral is provided a supply means 6 for depositing a continuous polyester fabric or lattice 7 on the first fleece layer 4. The fabric or lattice 7 is located on a delivery reel 8 which is drawn off by draw-off rollers 9. The fabric or lattice 7 passes over guide rollers 10 and a tension roller 11. The drive of draw-off rollers 9 is so matched with respect to the speed of conveyor belt 1 that the fabric or lattice 7 loosely drops in the area 12 below the draw-off rollers 9 so that it is placed on the first fleece layer 4 free from any forces. In the area 12, there is also a sensing device 13, which stops parts of the plant if there is no fabric or lattice 7 in the vicinity of the sensing device 13, e.g. if reel 8 is empty. Behind the fabric deposit is provided a further spreading means 14, which once again takes up fibres and supplies them via a spreading head 15 to give a uniform second fleece layer 16. A mill-like levelling means 17 is once again provided behind or upstream of the spreading means 14.

As can be gathered from FIG. 1, below the complete conveyor belt 1 and extending at least up to the second levelling means 17 is provided a suction means generally designated by the reference numeral 18 which, in FIG. 1, comprises two suction boxes 19, 20. This suction means 18 ensures that the first fleece layer 4 firmly engages on conveyor belt 1, that the fleece thickness is maintained, that the fabric or lattice 7 is sucked onto the first fleece layer 4 and, finally, that the second fleece layer 16 adheres on the lattice or fabric 7 and the first fleece layer 4.

Figure 2:
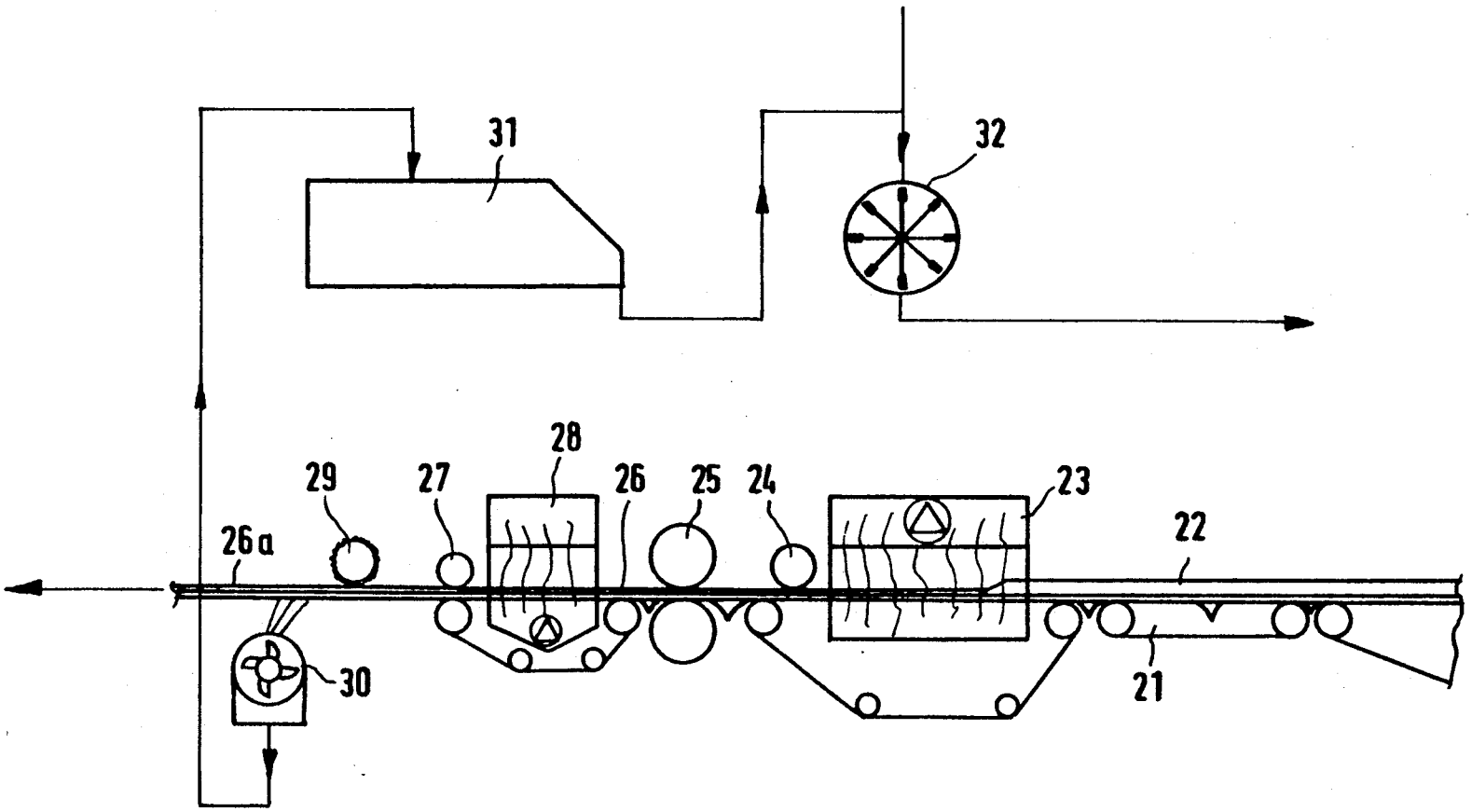

As shown in FIG. 2, the mat finally reaches a conveyor-type weigher 21, which measures the specific surface load and controls the second levelling means 17 and optionally also the first levelling means 5 in accordance with the desired value.

The final fleece 22 reaches a hot air means 23 by which hot air is forced or sucked through the final fleece 22 in order to activate the binder. Behind the hot air means 23 are provided a preforming roller 24 and a compression moulding calender 25, which reduce the fleece 22 to the desired end thickness. Fleece 22 leaves calender 25 as mat 26, which is moved by carrier rollers 27 through a cooling station 28. Behind carrier rollers 27 is located a trimming means 29, which levels the longitudinal edges of mat 26. The resulting edge strips can be comminuted by a cutting mill 30 and, subsequently, stored at 31 and, when required, material can be removed when required by the central comminuting mill 32, which is used for producing the fibrous material supplied to the spreading means 2 and 14.

Figure 4:
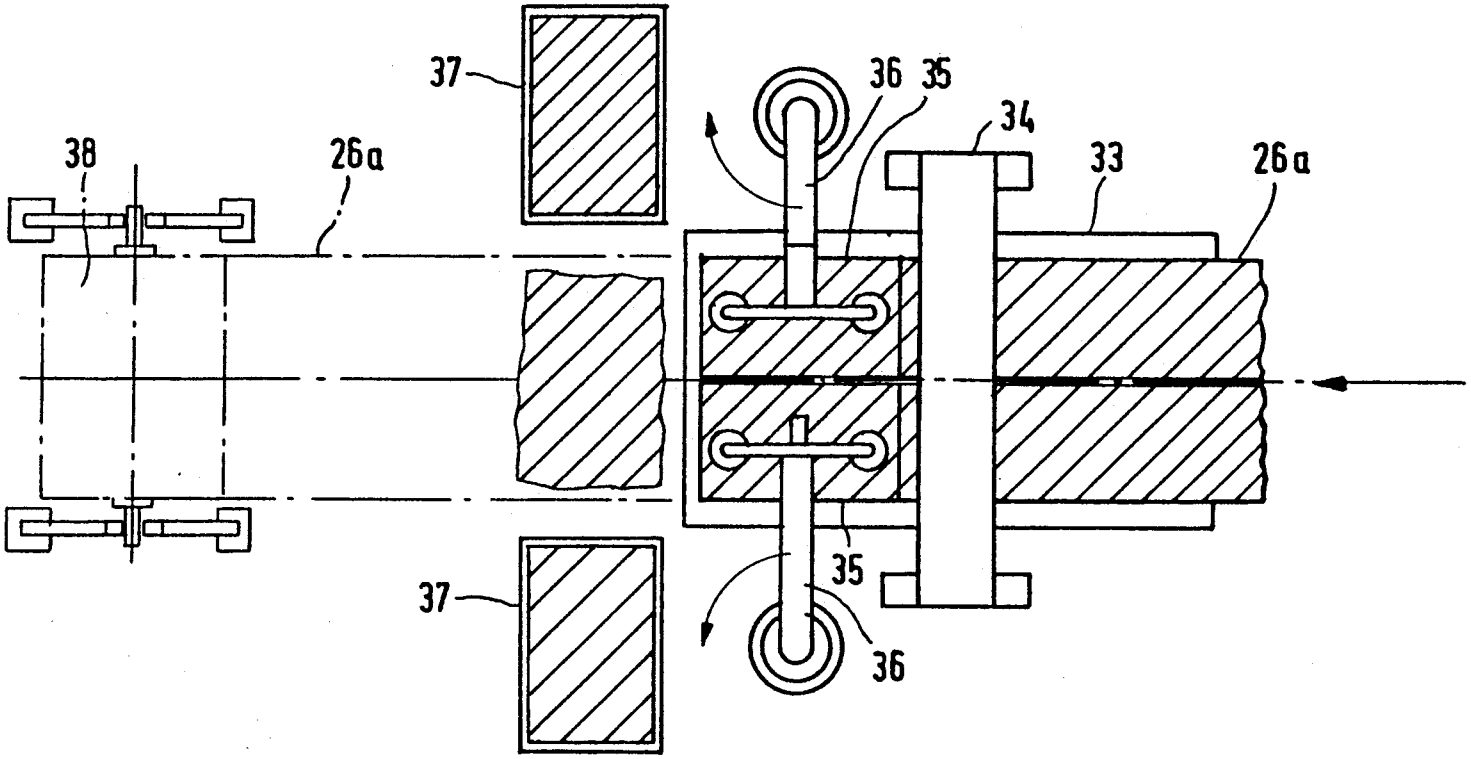
FIG. 4 is a schematic side view of an alternative apparatus for producing mat blanks.

The trimmed mat 27 prepared for further processing can then be wound up to form a reel or roll or, as shown in FIG. 4, can be cut into individual blanks. For this purpose, mat 27 runs onto a cutting table 33 with a cross-cutter 34. Simultaneously or beforehand, mat 27 is longitudinally cut, so that two blanks 35 are in each case formed behind the cross-cutter 34 and, by pivotable siphons or suction lifting means 36, are placed on lateral stacks 37. Dot-dash lines in FIG. 4 also show the alternative in which the mat 27 is wound up to form a reel 38.

Figure 3:
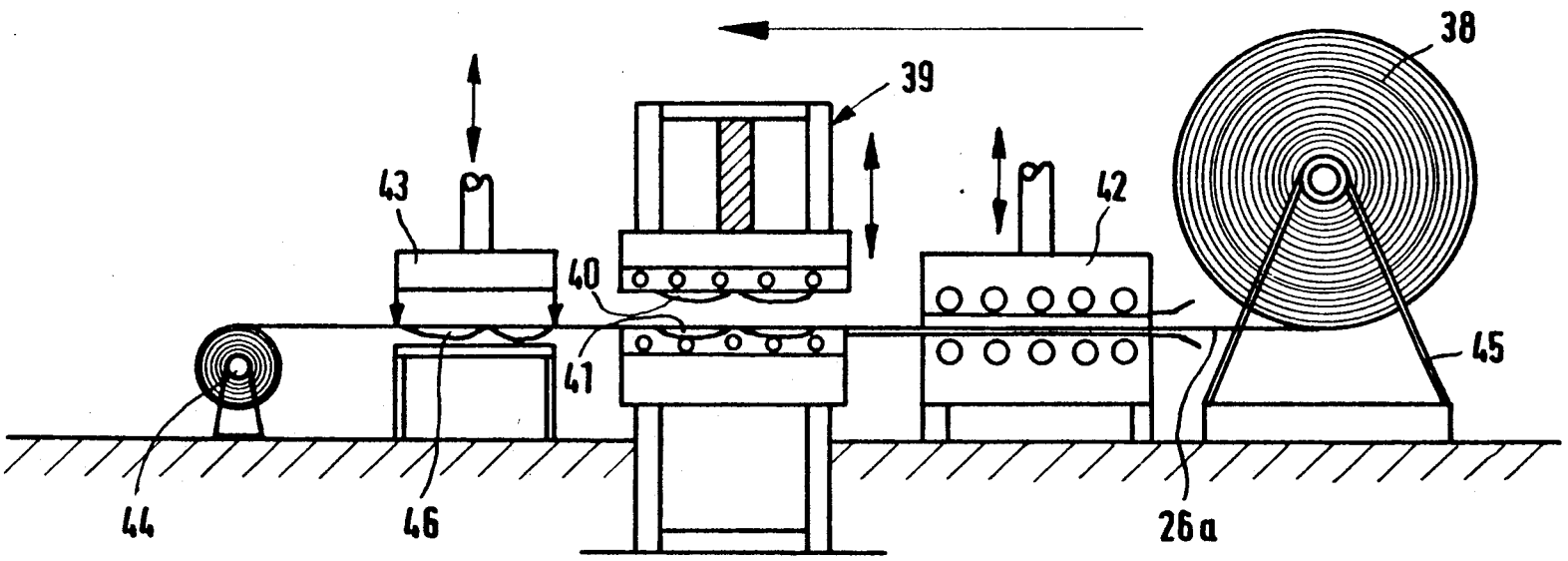
FIG. 3 is a schematic side view of the apparatus for producing a compression moulded article from a mat reel.

FIG. 3 is a diagrammatic view of an embodiment for producing compression moulded articles from a mat 27 wound up to form a reel 37. As its essential component, the plant has a moulding press 39 with a heated upper mould 40 and a heated lower mould 41 and in the represented embodiment the press stroke is performed by upper mould 40. Upstream of the moulding press 39 is provided a heating oven 42 and downstream thereof is a separating means 43 and behind this a winding means 44. Mat reel 38 is stored on a reel rack 45 upstream of the heating oven 42. The mat 27 is drawn off the reel 38 in timed manner by the winding means 44, firstly passed through oven 42 for activating the binder and during the next working stroke enters the moulding press 39. The moulds 40, 41 are closed, so that a moulded article is shaped from the mat and passed during the next working stroke into separating means 43 as a result of the still existing binding in the surrounding mat material. The moulded article 46 is then separated from the mat by a stamping or punching process and is moved away sideways, while the residual mat is wound up to form a reel again by winding means 44. As has already been described in connection with the marginal strips in FIG. 2, this material can be supplied to a comminuting means and then to the fibrous material production plant.

What is claimed is:

1. A process for producing fibrous mats for forming a starting material for compression moulded articles, the process comprising the steps of:

mixing fiberized waste materials with at least one of a thermoplastic and thermosetting binder;

spreading the mixed material onto an air permeable conveyor belt to form a first layer;

thermally conditioning one of a polyester fabric or lattice with multi-filament threads and a mesh size of between 4 mm and 7 mm at a temperature substantially corresponding to a mould temperature of the molded articles;

loosely placing one of the polyester fabric or lattice and a thermosetting heat activatable finish having an affinity to the binder of the fibers of the fiberized material on the first fleece layer;

constantly applying a vacuum to a bottom of the conveyor belt during placing of one of the polyester fibers or lattice on the first fleece layer;

spreading a second fleece layer onto the fabric or lattice; and compressing the first and second layers to form the fibrous mat.

2. A process according to claim 1, wherein a cross-section of at least part of the threads of the fabric or lattice has a greater extension parallel to a fleece plane than at right angles thereto.

3. A process according to claims 1 or 2, wherein the fabric or lattice finish comprises phenolic, phenol-resorcinol or melamine resins, or alternatively modified SBR latexes (styrene-butadiene latex with reactive carboxyl groups).

4. A process according to claim 1, further comprising the steps of winding the fibrous mat after the step of compressing to form reels, processing the fibrous mat from the reel for producing the compression moulded articles, and directly applying transport or conveying forces on the mat or waste strips obtained after trimming each moulded article and still connected via the remaining fabric or lattice.

5. A process according to claim 4, wherein the waste strips are fiberized and the fiberized waste materials are added again prior to fleece formation.

6. A process according to claim 1, further comprising the step of processing the fibrous mat so as to produce the compression moulded articles by a subsequent compression molding of the moulded articles at temperatures in a range of between 180° and 220° C.

* * * * *